US008651889B2

(12) United States Patent
Krech

(10) Patent No.: US 8,651,889 B2
(45) Date of Patent: Feb. 18, 2014

(54) CONNECTOR

(75) Inventor: Johann Krech, Horb am Neckar (DE)

(73) Assignee: Lapp Engineering & Co., Cham (CH)

( * ) Notice: Subject to any disclaimer, the term of this patent is extended or adjusted under 35 U.S.C. 154(b) by 0 days.

(21) Appl. No.: 13/402,404

(22) Filed: Feb. 22, 2012

(65) Prior Publication Data

US 2012/0225577 A1 Sep. 6, 2012

(30) Foreign Application Priority Data

Mar. 2, 2011 (EP) ..... 11156699

(51) Int. Cl.
*H01R 13/62* (2006.01)

(52) U.S. Cl.
USPC ..... 439/367

(58) Field of Classification Search
USPC ..... 439/368, 369, 519, 521, 588
See application file for complete search history.

(56) References Cited

U.S. PATENT DOCUMENTS

| | | | | |
|---|---|---|---|---|
| 2,688,651 | A * | 9/1954 | Blake | 174/93 |
| 3,452,321 | A * | 6/1969 | Carissimi et al. | 439/483 |
| 6,011,122 | A * | 1/2000 | Puyenbroek | 525/425 |
| 6,409,532 | B2 * | 6/2002 | Payson et al. | 439/320 |
| 6,435,911 | B1 * | 8/2002 | Payson et al. | 439/606 |
| 6,582,248 | B2 * | 6/2003 | Bachman | 439/462 |
| 6,869,316 | B2 * | 3/2005 | Hinkle et al. | 439/675 |
| 2003/0100215 | A1 * | 5/2003 | Bachman | 439/462 |
| 2004/0232598 | A1 | 11/2004 | Donea et al. | |
| 2005/0064752 | A1 * | 3/2005 | Serino | 439/320 |
| 2006/0035509 | A1 | 2/2006 | O'Connor | |
| 2010/0261367 | A1 | 10/2010 | Billman et al. | |
| 2010/0323554 | A1 | 12/2010 | Shiu | |
| 2011/0294324 | A1 | 12/2011 | Bihrer et al. | |

FOREIGN PATENT DOCUMENTS

EP 2105996 A1 9/2009

* cited by examiner

*Primary Examiner* — Ross Gushi
(74) *Attorney, Agent, or Firm* — Fraser Clemens Martin & Miller LLC; William J. Clemens

(57) ABSTRACT

The connector includes an electrically insulating one-part or multi-part housing, in which at least one contact element is arranged, which is accessible via a first opening of the housing by a contact element of a complimentary second connector, and which is connectable with an electrical cable that can be introduced through a second opening of the housing. The housing of the assembled connector, which is made from a first material, includes at least a first coupling element, which corresponds to at least one second coupling element that is included on a tubular element, which is manufactured from a second material which after processing includes a higher mechanical strength than the first material, and wherein the housing is releasably held within the tubular element by the releasably interlinked coupling elements.

12 Claims, 3 Drawing Sheets

Figure 1:
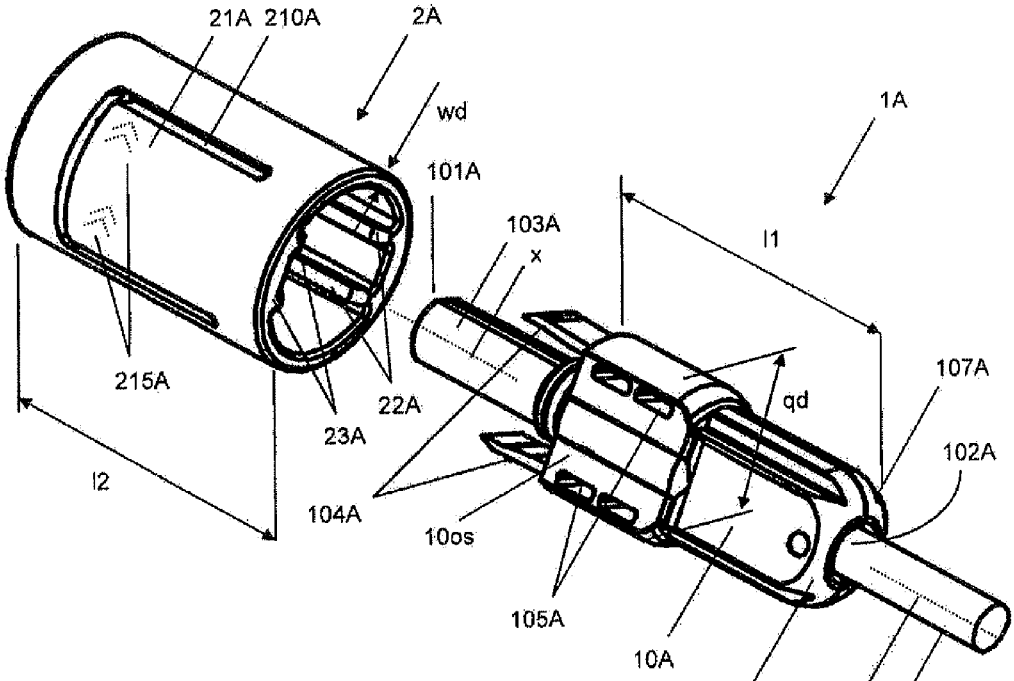

Fig. 5a
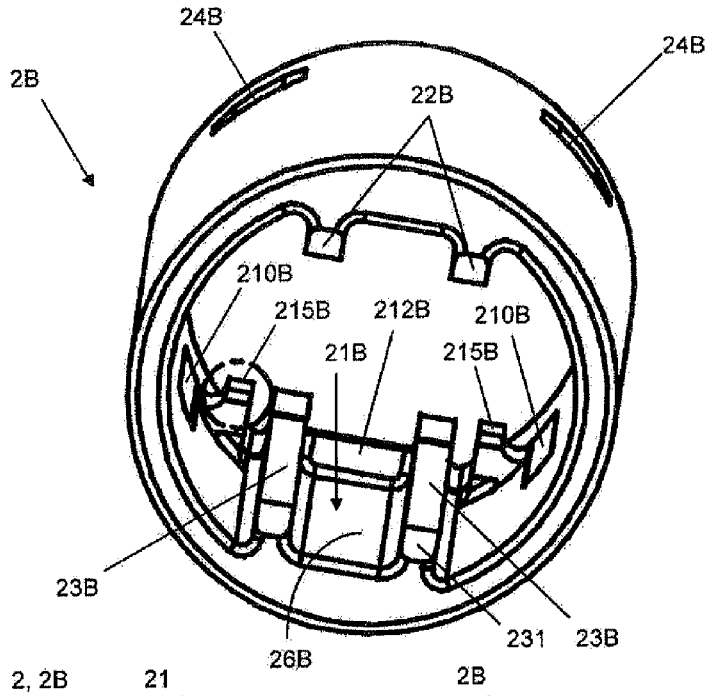
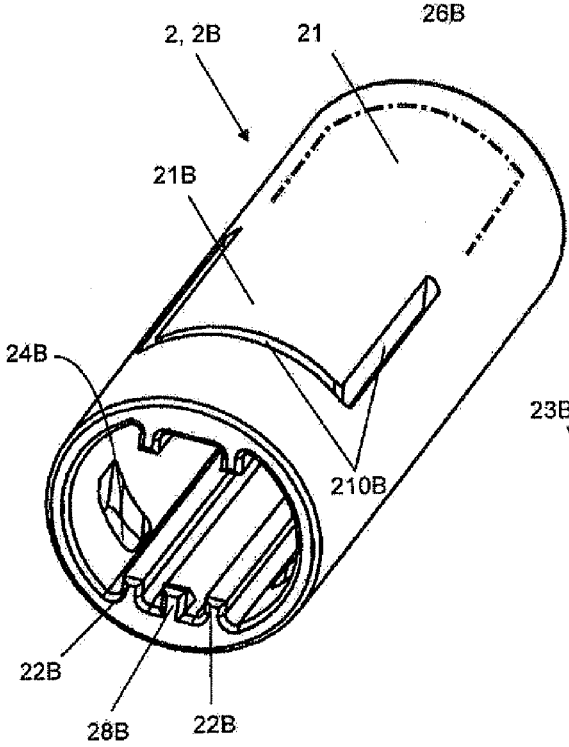
Fig. 5b
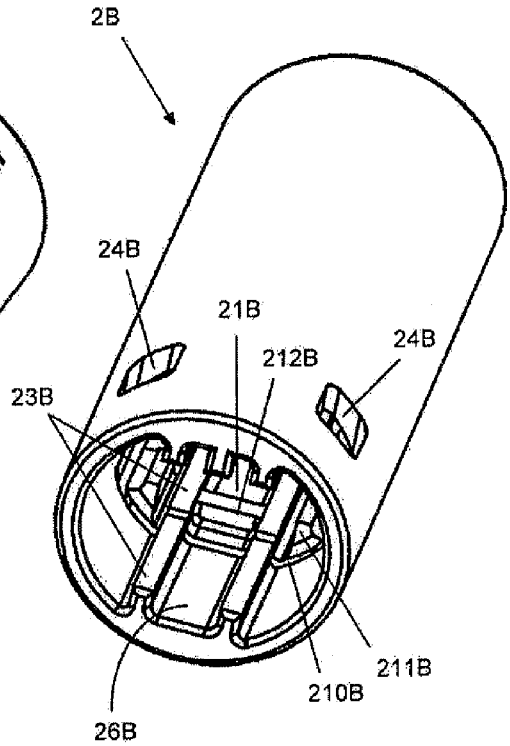
Fig. 5c

CONNECTOR

The present invention relates to a connector comprising an electrically insulating housing consisting of one or more parts and at least one contact element that is arranged in said housing and is accessible through a first opening in the housing by a contact element of a complementary connector and that is connectable with an electrical cable, which is introduced through a second opening into the housing.

Connectors of this kind, which are known e.g. from [1], US2011294324A, must meet various requirements that differ from one field of application to another.

Connectors used in photovoltaic systems must meet especially high requirements as defined in national standards. Required are for example a high creep resistance or a very good CTI (Comparative Tracking Index) value, a high level of fire protection as well as high mechanical strength, particularly good mechanical impact strength at low temperatures.

According to known standards the test for mechanical impact resistance is executed, by cooling down samples to −40° and then exposing the samples to mechanical shocks having an energy of 1 Joule. According to other standards a higher mechanical impact energy, e.g. of 6.8 J is applied. The test is passed, then no damage occurred, that would affect usability of the connector.

With special materials, it is possible to meet individual requirements relatively easily. However, difficulties arise when different requirements need to be met simultaneously. Depending on the material used, for example the required creep resistance is reached, but not the impact resistance. In the event that different requirements need to be met, the dimensions of plugs and sockets are increased under consideration of the selected material until all requirements are met. In the event that the connectors are used for high-voltage applications, then under consideration of the applied material dimensions of the housing are selected that provide correspondingly large creeping current distances.

By these measures not only undesirable large dimensions of the connectors but also high manufacturing costs result.

E.g. from [2], US 2010/0323554 A1, a connector with a housing is known, which serves for receiving and holding a plurality of base elements and contact elements. Furthermore, the housing comprises flange elements, with which the connected can be mounted for example on a printed circuit board. The connector and the housing are therefore designed for a specific application. In the event that different requirements are given, then another connector must be selected.

It should be noted that similar connectors are widely used in various application areas, in which entirely different requirements need to be met. Even if lower requirements are frequently given, often still only one type of connector is stored and used, which meets also higher requirements, and thus is relatively expensive.

It further must be noted, that parts of the housing, often need to fulfil further functions and therefore require corresponding characteristics such as a high elasticity.

[3], US2003100215A, discloses a durable data connector assembly for installation onto a cable connector and attached cable, which comprises a housing having positioning means for positioning the cable connector at a predetermined location within the housing and having thread means formed on a surface thereof; a radially-compressible chuck for urging the cable connector to the predetermined location and for gripping the cable; a tapered boot for radially compressing the chuck; and a threaded bushing for arresting the tapered boot and for mating to the threads on the housing in a threaded joint. By tightening the joint the bushing, boot, chuck, housing, and cable connector are compressed together to form the final assembly.

Assembling this connector therefore requires considerable efforts and various parts that cause rather high production costs. The assembly is mounted on a connector that is already connected to a cable. Therefore, all parts of the assembly need to be mounted onto the cable before the connectors are attached to the cable. After the connectors are attached on both ends of the cable, the remaining assembly parts are firmly linked to the cable and can no longer be removed. Consequently mounting of the assembly needs to be done before the connectors are mounted. In the event that the connectors have been mounted without the further assembly parts, then it is no longer possible to equip the cable and connectors with the system disclosed in [3]. Since a large-scale user does not assemble data cables himself, the cables including the connectors and further assembly parts are assembled at the production site. Consequently the user would evaluate what numbers of cables, with or without the enforcing assembly parts, would be required. Since exact numbers can scarcely be obtained in large installation sites, the user or installation manager would order and store various types of cables in excess.

The present invention is therefore based on the object of creating an improved connector, which better fulfils different high demands and which can be produced with lower manufacturing costs.

The improved connector shall be adaptable to the present technical requirements with little effort so that a user does not need to store several types of cables or connectors.

If required, the connector should be adaptable to given requirements such as a possible occurrence of higher mechanical impacts.

Furthermore, it shall be possible to advantageously lock and unlock an inventive connector after it has been connected to another complementary connector.

This object is achieved with a connector that comprises the features of claim 1. Preferred embodiments of the invention are defined in further claims.

The connector comprises an electrically insulating one-part or multi-part housing, in which at least one contact element is arranged, which is accessible via a first opening of the housing by a contact element of a complimentary second connector, and which is connectable with an electrical cable that can be introduced through a second opening of the housing.

According to the invention the housing of the assembled connector, which is made from a first material, comprises at least a first coupling element, which corresponds to at least one second coupling element that is provided on a tubular element, which is manufactured from a second material which after processing comprises a higher mechanical strength than the first material, and wherein the housing is releasably held within the tubular element by the releasably interlinked coupling elements.

The first material is selected in such a way, that the housing of the connector is optimised in view of functionality and primary characteristics, such as creep current resistance and/or fire protection. The second material is selected in such a way, that the tubular element is optimised in view of mechanical strength, particularly mechanical strength at low temperatures (low temperature impact resistance).

The inventive connector can therefore be adapted to given requirements at the installation site even after it has been connected to the cable. The tubular element can be mounted to the housing of the connector or released therefrom by interlocking or releasing the coupling elements to or from one another. The coupling elements can be created in such a way, that this action of mounting or releasing the tubular element can be done manually or with a dedicated tool that is only accessible by authorised personnel.

Hence, the user can store one type of connector that is already attached to a cable or that can be attached to the cable at the installation site and that can be equipped with little effort with the tubular element whenever required. This flexibility allows the engineer to decide at the point and time of installation, whether the installed connector requires additional protection are not. A tubular element can be mounted or dismounted within seconds. The installation can therefore be optimised in view of providing optimal protection of the installed connections as well as for most economical use of the resources.

The first material is a first plastic, preferably a modified Polyphenylene (PPE), which provides the housing with good insulation properties, temperature resistance, UV-resistance and adequate elasticity for functional parts, such as lock elements.

The second material is a second plastic, preferably a thermoplastic casting resin, which comprises polyimide-components and Siloxane-Copolymer-Components. Materials of this kind, which are known for example from [4], US6011122A and [5], US2004232598A1, exhibit a high temperature resistance as well as a high mechanical strength particularly at low temperatures.

With the inventive combination of these materials an optimised connector is achieved, which optimally satisfies various strict requirements and which therefore can advantageously be used for the most demanding conditions, e.g. in photovoltaic systems. The connector is not limited in its functionality and is optimally protected by the tubular element against mechanical impacts as well as contamination and thus maintains optimal electrical properties.

Preferably, the tubular element is used only then, when protection against mechanical impact is required. Depending on the requirements, the connector is therefore used with or without tubular element. In an electrical system, e.g. in a photovoltaic system, always the same type of connector can be used. For parts of the system, which are exposed to weather and mechanical impacts, e.g. in the connection field of solar energy modules, the connector is equipped with the tubular element.

For the connection of electrical cables in a protected area, e.g. in the range of an energy distribution unit, the connector can be used without a tubular element.

Hence, an inexpensive and small connector can be used and adapted to any given installation condition. For this reason, low costs occur for purchasing, storing and selectively using the unitary connector.

The dimensions of the tubular element, particularly its length, are adapted to the housing of the connector, so that at least the impact sensitive zone of the housing, preferably the complete housing, with or without extremities, is optimally protected.

The tubular element can easily be manufactured in dimensions which provide high stability. Preferably the tubular element is designed hollow-cylindrically, so that mechanical tension resulting from mechanical impacts is uniformly distributed across the tubular element, and not transferred or strongly reduced transferred to the housing of the connector. The tubular element, which is adapted to the housing of the connector, can be mounted onto the connector in the form of a slim sleeve. Therefore the dimensions of the connector are scarcely increased after mounting the tubular element. Compared to conventional connectors having increased dimensions for meeting given requirements the inventive connector exhibits with improved properties comparable or even reduced dimensions. Due to the cylindrical design of the tubular element a connector protected therewith exhibits a compact outer surface, which satisfies aesthetic requirements of professional products and scarcely requires cleaning and maintenance.

The tubular element can be coupled to the housing of the connector in various ways. The housing of the connector and the interior side of the tubular element are provided for example with coupling elements, which are designed as threaded elements corresponding to one another, as screws and threaded holes corresponding to one another, as openings and arresting bolts corresponding to one another or as openings and hooks corresponding to one another.

Preferably the coupling elements are integrated in one piece in the housing of the connector or in the tubular element, so that a minimal production effort is required.

The housing of the connector preferably comprises at least one receiving opening that is used and formed as a coupling element, into which the coupling elements of the tubular element can engage. In a further preferred embodiment, at least one pair of receiving openings is provided, so that a particularly stable connection is achieved. If a plurality of pairs of receiving openings is provided, then the tubular element can be arranged and fixed element at a desirable position.

In the event that two connectors are connected with one another, then it is sufficient, if only one of the connectors is provided with a tubular element, which at least partially, covers both connectors. In this embodiment the common tubular element can also serve as a locking device, which holds both interconnected connectors in place.

Coupling elements designed as threaded elements comprise an outer threaded surface provided on the housing of the connector as well as a corresponding inner threaded surface provided on the inner side of the tubular element. If desired or required by standards, that the connection between the coupling elements can only be released by means of a tool, then the outer side of the tubular element is provided with a profile that can be grasped by a tool, e.g. a wrench.

In a preferred embodiment at least one snap-in pin is partially cut out of the tubular element. At the free end of the snap-in pin at least one coupling element preferably designed as a hook is provided, which can engage in a receiving opening provided in the housing of the connector.

In this manner a simple coupling device is achieved, which can easily be operated, in order to couple and release the tubular element to and from the connector. The snap-in pin can be worked into the tubular element by simply applying a U-formed cut and can therefore easily be released from the housing of the connector, e.g. by introducing a screwdriver into the cut and by lifting the snap-in pin.

According to the invention the interconnected connectors can be enclosed by one or two tubular elements. The connectors can be provided with lock elements that engage with one another as soon as the complementary connectors are interconnected and that prevent the connectors from getting automatically separated.

In order to allow disconnection of the locking elements, the tubular element of the first or the second connector or a common tubular element are provided with at least one access opening, into which a tool can be introduced, with which a lock element of the first and/or of the second connector can be actuated in order to release the connectors from one another.

A common tubular element can advantageously be used, which comprises at least a first coupling element corresponding to a coupling element of the first connector and at least a second coupling element corresponding to a coupling element of the second connector. The common tubular element serves therefore not only for protection against mechanical impacts but also as a locking device, which holds and secures two interconnected connectors in position. The common tubular element preferably comprises two snap-in pins having lock elements, which engage in receiving openings of the housing of the first or second connector respectively.

The common tubular element protects the connection between the first and the second connector particularly good. A frequently occurring mutual turning or bending of the two connectors, which can cause breakage of material or loosening of the connection, is thereby avoided.

Further, using a common tubular element advantageously allows protecting the contact zone of two interconnected connectors against intrusion of water. For this purpose, an O-ring seal can be provided for each connector within the common tubular element. The O-ring seal prevents water from intruding between the opposing front sides of the first and of the second connector.

In preferred embodiments, the housing of the connector comprises two side planes aligned in parallel to one another, on which side planes first and second guide ribs abut, which are arranged on the inner side of the tubular element aligned in parallel to its longitudinal axis. The guide ribs hold the connector torque proof in position so that it cannot be turned within the tubular element. Between the guide ribs, preferably an air channel is kept open, through which air can circulate in order to remove moisture and thermal energy.

In order to facilitate mounting of the tubular element preferably at least one catch element is provided within the tubular element, which prevents the housing from further moving thus fixing its position.

Figure 2:
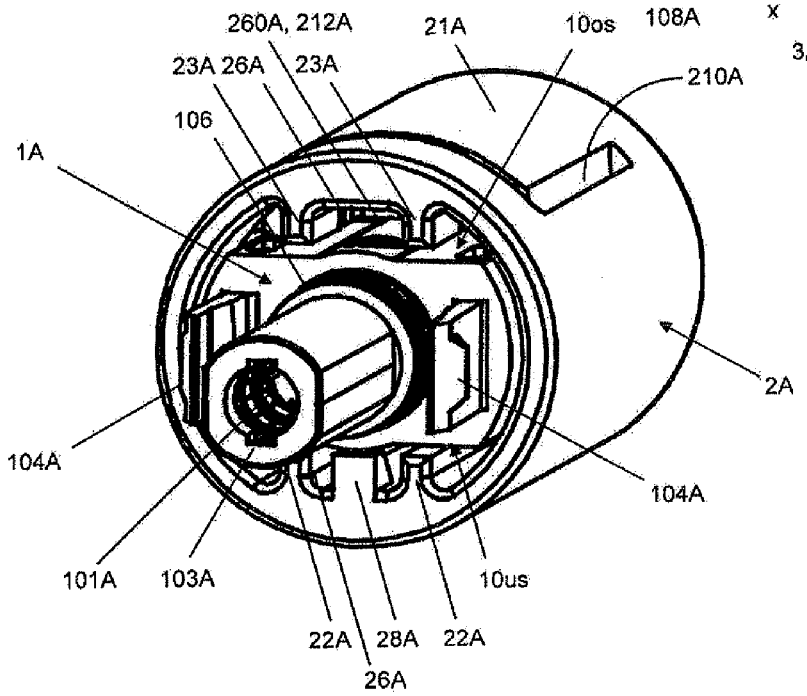
Figures 3, 4:
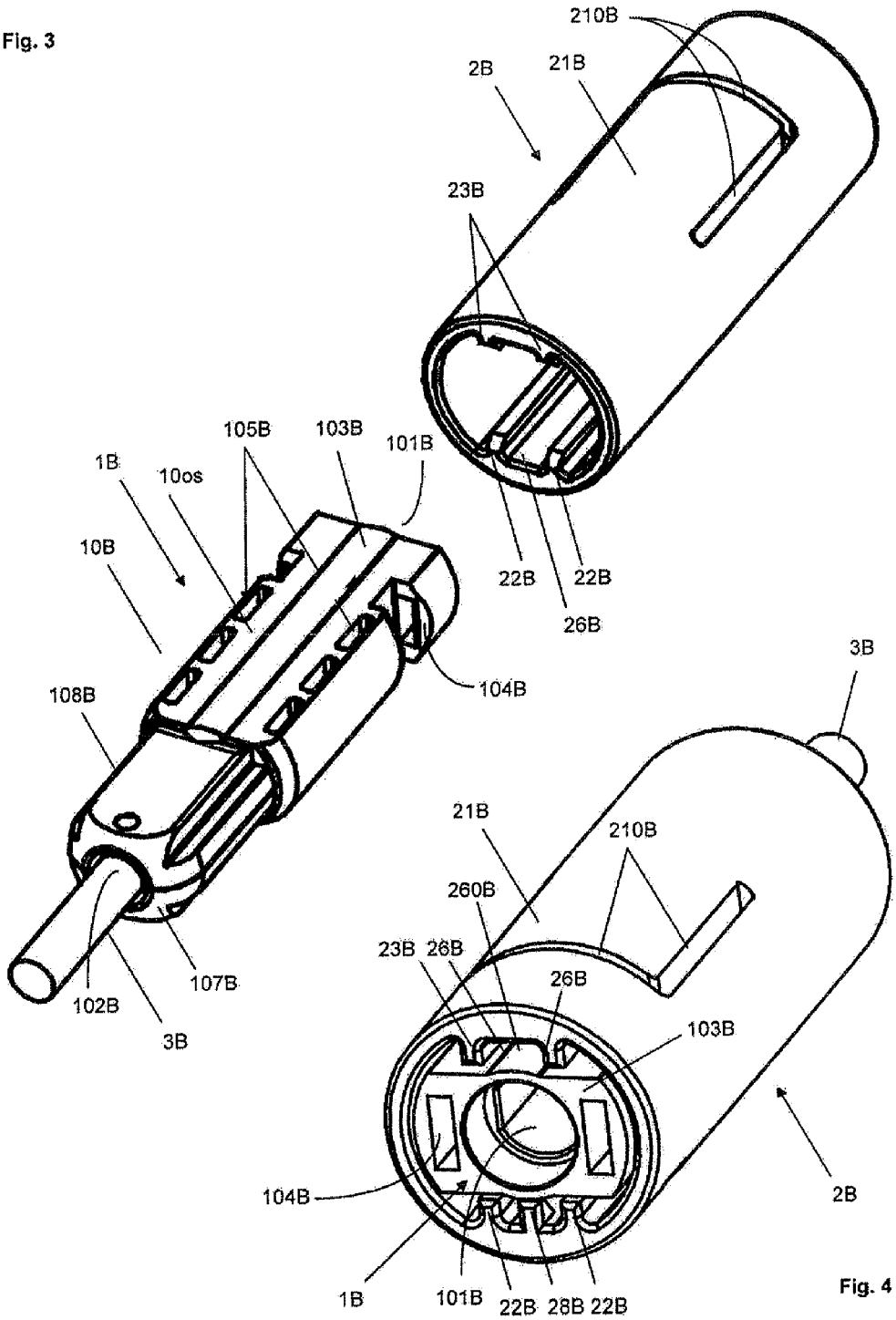

Below the invention is described in detail with reference to drawings. Thereby show:

FIG. 1 a first connector 1A in the embodiment of a male connector or plug with a related tubular element 2A;

FIG. 2 the connector 1A of FIG. 1 after it has been inserted into the related tubular element 2A;

FIG. 3 a second connector 1B in the embodiment of a female connector or bushing with a related tubular element 2B, which comprises a snap-in pin 21B on its upper side;

FIG. 4 the connector 1B of FIG. 3 after it has been inserted into the related tubular element 2B;

FIG. 5*a* the inner space of the cylindrical tubular element 2*b* of FIG. 3;

FIG. 5*b* the tubular element 2*b* of FIG. 5*a* with the snap-in pin 21B on its upper side; and FIG. 5*c* the tubular element 2*b* of FIG. 5*a* with the snap-in pin 21B on its lower side and access openings 24B on its upper side.

FIG. 1 shows a first connector 1A in the embodiment of a male connector with a related hollow cylindrical tubular element 2A, which serves for receiving the first connector 1A (see FIG. 2).

The connector 1A comprises an electrically insulating housing 10A, which consists of two housing shells 107A, 108A, that are connected with one another e.g. by means of a clip- or snap connection. The housing 10A comprises a centralised hollow cylindrical contact holder 103A on its front side, through which a first opening in the housing 101A leads into the interior space of the housing 10A. In the interior space of the housing 10A a contact element is provided, which extends along the contact holder 103A and which is connected with an electrical cable 3A, which is introduced through a second opening 102A provided on the rear side of the housing 10A.

Two tongue shaped lock elements 104A, which extend in parallel to and enclose the hollow cylindrical contact holder 103A in between, are connected in one piece with the housing 10A and are provided on their front sides with wedge-shaped latch elements.

The housing 10A of the first connector 1A (the same applies to the housing 10B of the second connector 1B shown in FIG. 3) further comprises a flat upper side 10*os* and a flat lower side 10*us* arranged in parallel thereto. From each edge of the upper side 10*os* two receiving openings 105A (105B respectively) extend to the lower side of the housing 10, which can fulfil various functions. If the connector 1A is used without tubular element 2A, ribbon like elements can be guided through the receiving openings 105A, e.g. in order to fasten the connector 1A. However, if the tubular element 2A is mounted on the connector 1A, then the receiving openings 105A serve as coupling elements for holding the tubular element 2A, which comprises thereto corresponding coupling elements 215A, in a selected position. The corresponding coupling elements 215A, which are shown in FIG. 1 in a dashed line (see the corresponding coupling elements 215B on the tubular element 2B of the second connector 1B in FIG. 5*a*), are provided on the interior side of the tubular element 2A (2B respectively) on the lower side of the snap-in pin 21A (21B respectively) facing the connector 1A (1B respectively), which snap-in pin 21A (21B respectively) having been laid open by means of a cut 210A (210B respectively) extending in U-form in the tubular element 2A (2B respectively). The length of the cut 210A (210B respectively) is selected in such a way, that the snap-in pin 21A (21B respectively) can be lifted by means of a tool as far as required to release the coupling elements 215A, 105A from one another.

The tubular element 2A (the same applies for the second tubular element 2B of FIG. 3) comprises a simple structure and consists of a thin-walled hollow cylinder with an inner diameter, which preferably corresponds approximately to the largest cross diameter qd of the connector 1A extending perpendicularly to the longitudinal axis x. The wall thickness wd of the tubular element 2A lies preferably approximately in the range of ⅕ to 1/10 of the inner diameter. When using standard sizes of the connector, wall-thicknesses wd in the range of 0.5 mm to 2.5 mm are useful. However, the wall-thicknesses wd are selected depending on the expected mechanical impacts and under consideration of the applied materials. Furthermore, preferably enforcing elements, such as longitudinal ribs and/or cross ribs, are provided on the inner side and/or the outer side of the tubular element 2A, with which the tubular element 2*a* is enforced or stiffened. With the proposed materials, preferably thermoplastic casting resin preferably comprising Polyimide-Components and Siloxane-Copolymer-Components, very good protection can be achieved for the connector 1A already with small dimensions of the tubular element 2A. It must be noted, that the applied materials with the high resistance against mechanical impacts of the material used for the tubular element 2A and the relatively high elasticity of the material used for the connector 1A an optimal interaction is achieved. Thereby it is not required that the tubular element 2A completely absorbs the energy of the mechanical impact. However it is important, that the energy of the mechanical impact, which is transferred from the tubular element 2A to the housing 10A of the connector 1A, is reduced so far that the energy of a mechanical impact absorbed by the housing 10A of the connector 1A does not cause damage.

By this load sharing a significant improvement of all relevant properties of the connector 1A can be achieved while applying small dimensions of the tubular element 2A. In order to reach overall mechanical protection the length l2 of the tubular element 2A is preferably selected approximately corresponding to the length l1 of the housing 10A (without extremities 103A, 104A) of the connector 1A.

FIG. 1 further shows that inside the tubular element 2A two pairs of guide ribs 22A, 23A are arranged, opposing one another, extending axially, and preferably comprising mounting slants 231. The second pair of the guide ribs 23A extends below the snap-in pin 21A and is interrupted by the U-formed cut 210A of the snap-in pin 21A at a corresponding position. After the tubular element 2A has been mounted, the guide ribs 22A, 23A abut the upper side 10*os* or the lower side 10*us* respectively of the housing 10A of the connector 1A and hold the connector 1AA torque proof and practically without play within the tubular element 2A. The guide ribs 22A, 23A simultaneously serve for enforcing and stiffening the tubular element 2A. Air channels 26A are provided between the guide ribs 22A, 23A, through which air can circulate and can remove moisture and thermal energy.

FIG. 2 shows the connector 1A of FIG. 1 after it has been inserted into the tubular element 2A. It can be seen that the housing 10A of the connector 1A, which is held on the front side by means of a catch element 28A, is supported laterally by the tubular element 2A and on the other and lower side by the guide ribs 22A, 23A provided on the inside of the tubular element 2A. The extremities of the connector, namely the hollow cylindrical contact holder 23A and the tongue shaped lock elements 104A protrude on the front side out of the tubular element 2A. The resulting connector 1A, which is enforced with the tubular element 2A, is only slightly larger than the connector 1A without the thin-walled tubular element 2A. However, FIG. 2 shows that the connector 1A that is enforced with the tubular element 2A has a compact outer surface, which does not exhibit any weak points.

Further, between the guide ribs 23A a clearance 260A is provided, into which a tool, e.g. the blade of a screwdriver can be introduced against the front part of the snap-in pin 21A, on which a wedge 212A is provided. By introducing the tool on the front side the wedge 212A and therefore the front part of the snap-in pin 21A is pushed upwards, releasing the coupling elements 215A provided on the front part out of the receiving openings 105A to of the housing 10A of the connector 1A (see the corresponding embodiment of the tubular element 2B provided for the second connector 1B in FIGS. 5*a* and 5*c*). However, without a corresponding tool the tubular element 2A cannot be released from the housing 10A of the connector 1A.

FIG. 3 shows a second connector 1B in the embodiment of a bushing with a related hollow cylindrical tubular element 2B, which serves for receiving the second connector 18 (see FIG. 4).

The second connector 1B comprises an electrically insulating housing 10B, which consists of two housing shells 1078, 108B, which are connected with one another. The housing 10B comprises on its front side a first opening that is forming a contact receiver 1038, into which the contact holder 103A of the first connector 1A can be inserted. In the interior space of the housing 108 a contact element is provided, which is connected to an electrical cable 3B that is introduced through a second opening 1028 that is provided on the rear side of the housing 108.

Two lock elements 104B are formed on the housing 10B in the embodiment of lugs that are arranged in parallel enclosing the contact receiver 103B in between. The lock elements 104B serve for receiving the tongue shaped lock elements 104A of the first connector 1A.

As described above, the housing 10B of the second connector 1B also comprises a flat upper side 10*os* and a flat lower side 10*us* arranged in parallel thereto. From each edge of the upper side 10*os* three receiving openings 105B extend to the lower side of the housing 10, which serve i.a. as coupling elements for mounting the tubular element 2B, which comprises a snap-in pin 21B with corresponding coupling elements 215B.

The second connector 1B can therefore also be inserted up to a catch element 28B provided in the second tubular element 2B, so that the connector 1B then abuts laterally the inner wall of the second tubular element 2B and on the upper and the lower side the guide ribs 22B, 23B, between which air channels 26B are provided. The tubular element 2B can be released again, by lifting the snap-in pin 21B of the second tubular element 2B with the coupling elements 215B out of the coupling elements 105B, i.e. the coupling openings provided in the housing 10B of the second connector 1B, so that the tubular element 2B can be removed. For this purpose, again the blade of a screwdriver can be introduced on the front side of the snap-in pin 21B into a clearance 260B against a wedge 212B provided on the snap-in pin 21B (see FIGS. 5*a* and 5*c*), in order to lift the front part of the snap-in pin 21B.

FIG. 4 shows that the second connector 1B does not comprise extremities extending outside and is therefore with its front side arranged flush with the front side of the second tubular element 2B. The extremities 103A, 104A of the first connector 1A are therefore introduced into the second connector 1B that is designed as bushing and therefore into the second tubular element 2B. After the connection of the complementary connectors 1A, 1B, lock elements 104A, 104E of the connectors 1A, 1B are coupled or latched with one another and can therefore be released from one another only, if the second tubular element 2B provides access to the lock elements 104A, 104B.

FIGS. 5*a*, 5*b* and 5*c* show that access openings 24B can be provided in the second tubular element 2B, through which a tool can be guided to the lock elements 104A, 104B, in order to release them from one another. For example, the tips of a forked gripper can be introduced into the access openings 24B.

FIG. 5*a* shows the interior space of the cylindrical tubular element 2*b* of FIG. 3. It is shown, that the guide ribs 23A extend across the snap-in pin 21B, which comprises the front part with the wedge 212B and the coupling elements 215B, which exhibit the form of hooks or cams that can be received by the openings 105B in the housing 10B of the second connector 1B.

FIG. 5*b* shows schematically that a tubular element 2 can comprise a plurality of snap-in pins 21B, 21, so that two connectors 1A, 1B can be introduced into a common tubular element 2. Since the coupling elements 215 of the snap-in pins 21 can engage in both connectors 1A, 1B, the common tubular element 2 therefore serves not only for protecting the inserted connectors 1A, 1B, which are held axially aligned, but also as a locking device, with which the two interconnected connectors 1A, 1B are held in position.

LITERATURE

[1] US2011294324A
[2] US2010/0323554 A1
[3] US2003100215A
[4] US6011122A
[5] US2004232598A1

List of References

1A, 1B first and second connector
10A, 10B housing of the connector 1A, 1B
10*os* upper side of the housing 10A, 108
10*us* lower side of the housing 10A, 10B
101A, 101B first opening in the housing 10A, 10B
102A, 102B second opening in the housing 10A, 108
103A contact holder on the first connector 1A
1038 contact receiver on the second connector 1B
104A lock element on the first connector 1A
104B lock element on the second connector 1B
105A, 105 coupling elements on the connector 1A or 1B
106 O-ring seal on the contact holder
107A, 107B first housing shell
108A, 108B second housing shell
2 common tubular element
2A, 2B first and second tubular element
21 snap-in pins of the common tubular element
21A, 218 snap-in pin
210A, 210E cut to expose the snap-in pins 21A, 218
212A, 212B wedge
215A, 215B coupling elements on the snap-in pins 21A, 21B
22A, 22B first pair of guide ribs
23A, 23B second pair of guide ribs
231 mounting slant
24B access openings
26A, 26B air channels between the guide ribs 23A, 23B
260A, 260B clearance
28A, 28B catch element
3A, 3B electrical cable

The invention claimed is:

1. Connector comprising an electrically insulating one-part or multi-part housing that is releasable held within a tubular element, and in which at least one contact element is arranged, which is accessible via a first opening in the housing by a contact element of a complimentary second connector, and which is connectable with an electrical cable that can be introduced through a second opening in the housing, wherein the housing of the assembled connector, which is made from a first material, comprises at least a first coupling element, which corresponds to at least one second coupling element that is provided on a tubular element, which is manufactured from a second material which after processing comprises a higher mechanical strength than the first material, and wherein the housing is releasably held within the tubular element by the releasably interlinked coupling elements and wherein the tubular element is provided with at least one snap-in in that is cut out of the tubular element and that comprises at its free end at least a coupling element formed as a hook, which engages in the receiving opening.

2. Connector according to claim 1, wherein the housing is provided with at least one coupling element that is designed as a receiving opening.

3. Connector according to claim 1, wherein the housing comprises two side planes aligned in parallel to one another, on which first and second guide ribs, which run on the inner side of the tubular element in parallel to its longitudinal axis, abut and torque proof hold the connector.

4. Connector according to claim 3, wherein at least one air channel is provided between the guide ribs.

5. Connector according to claim 1, wherein at least a catch element is provided within the tubular element, which abuts on the housing of the inserted connector thus preventing further movement of the connector.

6. Connector according to claim 1, wherein the first connector and a thereto complimentary second connector are connected with one another, if appropriate interlocked, and are provided with a common tubular element or with two tubular elements.

7. Connector according to claim 1, wherein the tubular element of the first and/or of the second connector is provided with at least one access opening, into which a tool is insertable, with which a lock element of the first and/or of the second connector can be actuated.

8. Connector according to claim 6, wherein a common tubular element comprises at least a first coupling element corresponding to a coupling element of the first connector as well as at least a second coupling element corresponding to a coupling element of the second connector.

9. Connector according to claim 1, wherein the first material is Polyphenylene (PPE).

10. Connector according to claim 1, wherein the second material is a thermoplastic casting resin, which comprises Polyimide-Components and Siloxane-Copolymer-Components.

11. Connector according to claim 1, wherein the length of the connector corresponds at least approximately to the length of the tubular element.

12. Connector according to claim 1, wherein the tubular element is designed hollow cylindrically and comprises a wall thickness that is in the range of ⅕ to ⅒ of the inner diameter of the tubular element.

* * * * *